US012140137B2

(12) United States Patent
Kornfeld et al.

(10) Patent No.: US 12,140,137 B2
(45) Date of Patent: Nov. 12, 2024

(54) RECIPROCATING COMPRESSOR WITH VARIABLE CAPACITY REGULATION

(71) Applicant: Hoerbiger Wien GmbH, Vienna (AT)

(72) Inventors: Matthias Kornfeld, Vienna (AT); Klaus Stachel, Vienna (AT); Lili Wang, Vienna (AT)

(73) Assignee: Hoerbiger Wien GmbH, Vienna (AT)

( * ) Notice: Subject to any disclaimer, the term of this patent is extended or adjusted under 35 U.S.C. 154(b) by 61 days.

(21) Appl. No.: 17/740,337

(22) Filed: May 9, 2022

(65) Prior Publication Data

US 2022/0356874 A1 Nov. 10, 2022

(51) Int. Cl.
*F04B 49/03* (2006.01)
*F04B 39/10* (2006.01)
*F04B 53/10* (2006.01)

(52) U.S. Cl.
CPC ..... *F04B 53/10* (2013.01); *F04B 39/1053* (2013.01); *F04B 49/03* (2013.01); *F04B 2201/1208* (2013.01); *F04B 2205/16* (2013.01)

(58) Field of Classification Search
CPC ..... F04B 49/03; F04B 39/1053
See application file for complete search history.

(56) References Cited

U.S. PATENT DOCUMENTS 2,246,932 A * 6/1941 Collins ..... F04B 49/007 417/62
4,384,826 A * 5/1983 Gregg ..... F04B 49/16 417/299
4,799,507 A * 1/1989 Hrabal ..... F04B 39/10 137/516.21
4,869,289 A * 9/1989 Hrabal ..... F16K 15/063 137/512.1
5,695,325 A 12/1997 Sperry
5,735,675 A 4/1998 Peoples et al.
5,833,209 A * 11/1998 Steinruck ..... F04B 49/22 251/47
9,562,527 B2 2/2017 Spiegl et al.
(Continued)

FOREIGN PATENT DOCUMENTS

AT 512790 B1 * 11/2013 ..... F04B 39/08
AT 522973 A4 * 4/2021 ..... F04B 35/045
(Continued)

*Primary Examiner* — Thomas Fink
(74) *Attorney, Agent, or Firm* — Dykema Gossett PLLC

(57) ABSTRACT

Various embodiments of the present disclosure are directed to reciprocating compressors. In one example embodiment, a reciprocating compressor is disclosed including a cylinder, a piston, at least one suction valve, at least one pressure valve, at least one connection chamber, a sequence valve, a sequence valve control unit, and an unloader. The piston moves back and forth in the cylinder in order to form a compression chamber in the cylinder. The at least one suction valve and the at least one pressure valve are provided on the compression chamber. The at least one connection chamber having a connection chamber volume, which is connected to the compression chamber via at least one overflow opening. The sequence valve opens and closes the at least one overflow opening, and the sequence valve control unit controls the sequence valve. The unloader is actuated by an electrically controllable actuator.

11 Claims, 4 Drawing Sheets

(56) References Cited

U.S. PATENT DOCUMENTS

| | | | | |
|---|---|---|---|---|
| 2004/0091365 | A1* | 5/2004 | Spiegl | F04B 39/08 417/298 |
| 2005/0120730 | A1 | 6/2005 | Chen et al. | |
| 2010/0086415 | A1* | 4/2010 | Spiegl | F04B 49/243 417/505 |
| 2012/0207623 | A1* | 8/2012 | Allenspach | F04B 39/08 417/298 |
| 2012/0260796 | A1* | 10/2012 | Spiegl | F04B 7/0076 91/459 |
| 2015/0044081 | A1* | 2/2015 | Babbini | F04B 49/225 417/559 |
| 2018/0363794 | A1* | 12/2018 | Galeotti | F04B 39/1013 |
| 2019/0293064 | A1* | 9/2019 | Sanford | F04B 49/06 |
| 2022/0243722 | A1* | 8/2022 | Sanford | F04B 49/243 |

FOREIGN PATENT DOCUMENTS

| | | | | |
|---|---|---|---|---|
| CA | 3116261 | A1 * | 10/2021 | F04B 39/1013 |
| CN | 111188759 | A | 5/2020 | |
| DE | 688429 | | 2/1940 | |
| EP | 2876303 | B1 | 12/2017 | |
| EP | 2511526 | B1 * | 8/2019 | F04B 39/08 |
| GB | 487916 | A | 6/1938 | |
| WO | 2011009879 | A1 | 1/2011 | |
| WO | 20913092390 | A1 | 6/2013 | |
| WO | 2017174717 | A1 | 10/2017 | |

* cited by examiner

RECIPROCATING COMPRESSOR WITH VARIABLE CAPACITY REGULATION

CROSS-REFERENCE TO RELATED APPLICATION

This application is claims the benefit of priority to Austria application No. A 50359/2021, filed 10 May 2021, which is incorporated herein by reference.

BACKGROUND

The invention relates to a reciprocating compressor with a piston which can be moved back and forth in a cylinder in order to form a compression chamber in the cylinder, wherein at least one suction valve and at least one pressure valve are provided on the compression chamber, wherein at least one connection chamber with a fixed connection chamber volume is provided, which is connected to the compression chamber via an overflow opening, wherein a sequence valve is provided for opening and closing the overflow opening and a sequence valve control unit is provided for activating the sequence valve. Furthermore, the invention relates to a method for operating such a reciprocating compressor and to a valve assembly for a reciprocating compressor.

The regulation of the capacity or the delivery rate of a reciprocating compressor by means of a connection chamber is a well-established principle that is mainly used in reciprocating compressors with a constant speed. The dead space can be increased by the connection chamber, so that the pressure increase and decrease rate of the compressor is flattened and the quantity of the conveyed medium can be reduced. This form of regulation is hardly lossy and is often used, especially in medium-sized and large compressors, to adjust the operating point of the compressor to its drive. The type of change in the volume of the dead space by means of the connection chamber can in principle take place in two ways. On the one hand, one or more connection chambers with an unchangeable volume can be provided and can be connected in series or in parallel via one or more valves. On the other hand, a connection chamber with a variable volume can be provided, wherein the volume is variable by movement of a piston.

A gradual connection of several connection chambers with different volumes is known, for example, from CN 111188759 A or U.S. Pat. No. 5,735,675 A. In this case, individual partial volumes of the connection chamber are connected to the compression chamber via hydraulic or pneumatic actuators by opening of a valve. Depending on the design, connection is relatively slow compared to the compressor speed. The sequence valve remains open over a longer period of time, so that the associated connection chamber remains connected to the compression volume. This type of regulation makes it possible to change the quantity of the conveyed medium only in discrete steps; stepless and precise quantity regulation is not possible.

Designs are also known from GB 487916 A, in which the sequence valve can be kept closed via a mechanical spring or a pneumatically or hydraulically adjustable closing pressure. These valves open automatically as soon as the pressure in the compression chamber exceeds the closing pressure on the sequence valve. When the sequence valve opens, the connection chamber volume is connected during the compression process and from this time the pressure increase curve is flattened. By adaptation of the closing pressure and thus the time of connection of the connection chamber, it is possible to achieve a simple stepless control of the gas quantity delivered. However, this design also allows only a slow adjustment of the connection time compared to the compressor speed. Due to compressibility effects in the region of the pneumatic or hydraulic closing pressure application as well as friction effects on the valve sealing elements, the opening time of the valve and thus the quantity of gas delivered is greatly dependent on these effects. Precise control of the quantity of gas delivered is only possible to a limited extent with this design.

It is therefore an object of the present invention to provide an improved stepless capacity regulation by means of a connection chamber for a reciprocating compressor, by which a more precise and faster adaptation of the delivery rate is made possible even in the case of large reciprocating compressors.

SUMMARY OF THE INVENTION

This object is achieved according to the invention in that the sequence valve is designed as an automatic ring valve which automatically opens and closes the overflow opening depending on a pressure ratio between a pressure in the connection chamber and a pressure in the compression chamber, wherein the sequence valve opens automatically when the pressure in the connection chamber is greater than the pressure in the compression chamber, in that an unloader is provided, which can be actuated by an electrically controllable actuator in order to keep the sequence valve in an open state independently of the pressure ratio, and in that the electromagnetic actuator can be controlled by the sequence valve control unit for actuation. This makes it possible to react very precisely to load changes of the compressor within a very short time, in particular within one compression cycle or one revolution of the crankshaft, which was previously not possible due to the seat valves used and in particular due to the relatively slow pneumatic or exclusively hydraulic actuation.

A flow cross-sectional area of the overflow opening in the open state of the sequence valve is preferably at least 5%, preferably at least 10%, particularly preferably at least 15%, of a bore cross-sectional area of a bore of the cylinder. The bore diameter of the bore of the cylinder is preferably at least 100 mm, preferably at least 500 mm, particularly preferably at least 800 mm. The throttling losses can be reduced by large flow cross sections and the force required to keep the valve open can be reduced. The advantage of the ring valve increases in particular with the size of the compressor, in particular the bore diameter.

The actuator preferably has a switching frequency of at least 5 Hz, preferably at least 10 Hz, particularly preferably at least 20 Hz. An electromagnetic actuator or an electrohydraulic actuator is advantageously provided as the actuator. As a result, very precise closing times of the valve can be achieved. Electromagnetic actuators and electrohydraulic actuators are particularly well suited for this.

It is advantageous if the suction valve and/or the pressure valve is also designed as an automatic valve, preferably as an automatic ring valve, because this means that no actuators are required for actuation. The suction valve and/or the pressure valve are preferably arranged on a peripheral surface of the cylinder in the compression chamber and/or the sequence valve is arranged on an end face of the cylinder of the reciprocating compressor opposite a piston head of the piston. This is advantageous because there is a lot of space for the sequence valve on the end face. In addition, simple installation and retrofitting of the sequence valve can thereby be made possible.

The sequence valve preferably has a plurality of concentrically arranged, at least partially annular overflow openings, wherein each overflow opening is assigned a sealing element and the unloader acts on the sealing elements through the annular overflow openings. As a result, the flow cross section can be increased and the throttling forces reduced. It can be advantageous here if a plurality of annular sealing elements are connected via radial webs to form a sealing plate, as a result of which fewer individual components are required, which makes assembly easier, for example.

Furthermore, it can be advantageous for the sequence valve to have a valve housing in which the connection chamber is provided, wherein the electromagnetic actuator is arranged outside the valve housing and is connected to the unloader via a transmission rod which protrudes through a wall of the valve housing into the connection chamber. As a result, the actuator can be protected from the high temperatures and pressures in the connection chamber and a simple connection to the control unit is possible.

The sequence valve control unit is preferably designed to control the sequence valve depending on a load signal and/or depending on a crank angle signal of the reciprocating compressor. As a result, the connection chamber can advantageously be connected and disconnected depending on the operating state of the reciprocating compressor.

The object is also achieved with a valve assembly in that the sequence valve is designed as an automatic ring valve which automatically opens and closes the overflow opening depending on a pressure ratio between a pressure in the connection chamber and an ambient pressure, wherein the sequence valve opens automatically when the pressure in the connection chamber is greater than the ambient pressure, and in that an unloader is provided which can be actuated by an electrically controllable actuator in order to keep the sequence valve in an open state independently of the pressure ratio, wherein the actuator can be controlled by the sequence valve control unit for actuation.

In addition, the object is achieved with a method in that the sequence valve opens automatically at an opening point in the expansion stroke before the suction valve opens when a pressure in the connection chamber is greater than a pressure in the compression chamber, wherein the unloader is activated in order to keep the sequence valve in the open state independently of the pressure in the connection chamber and the pressure in the compression chamber, and the unloader is deactivated after the closing of the suction valve at a certain time in the compression stroke, so that the sequence valve closes automatically at a fixed closing point in the compression stroke due to the pressure in the compression chamber, which is higher relative to the pressure in the connection chamber, wherein the unloader is actuated by the actuator and the actuator is controlled by the sequence valve control unit.

BRIEF DESCRIPTION OF THE DRAWINGS

The present invention is explained in greater detail below with reference to FIG. 1*a* through 3*d* which show, by way of example, advantageous embodiments of the invention in a schematic and non-limiting manner. In the drawings.

DETAILED DESCRIPTION

Figure 1A:
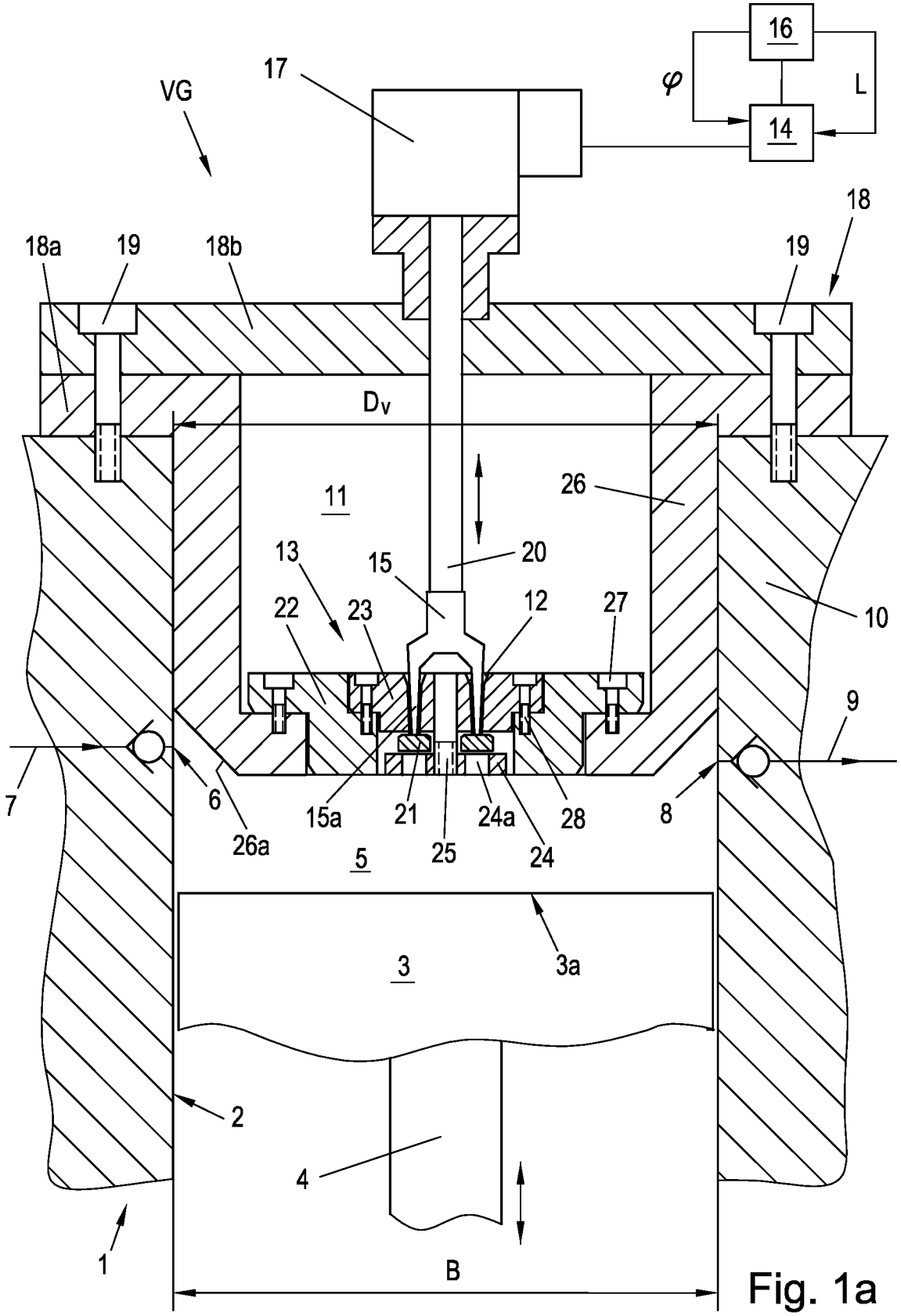
FIG. 1*a* shows a cylinder of a reciprocating compressor, on which a valve assembly with a connection chamber is arranged.
Figure 1B:
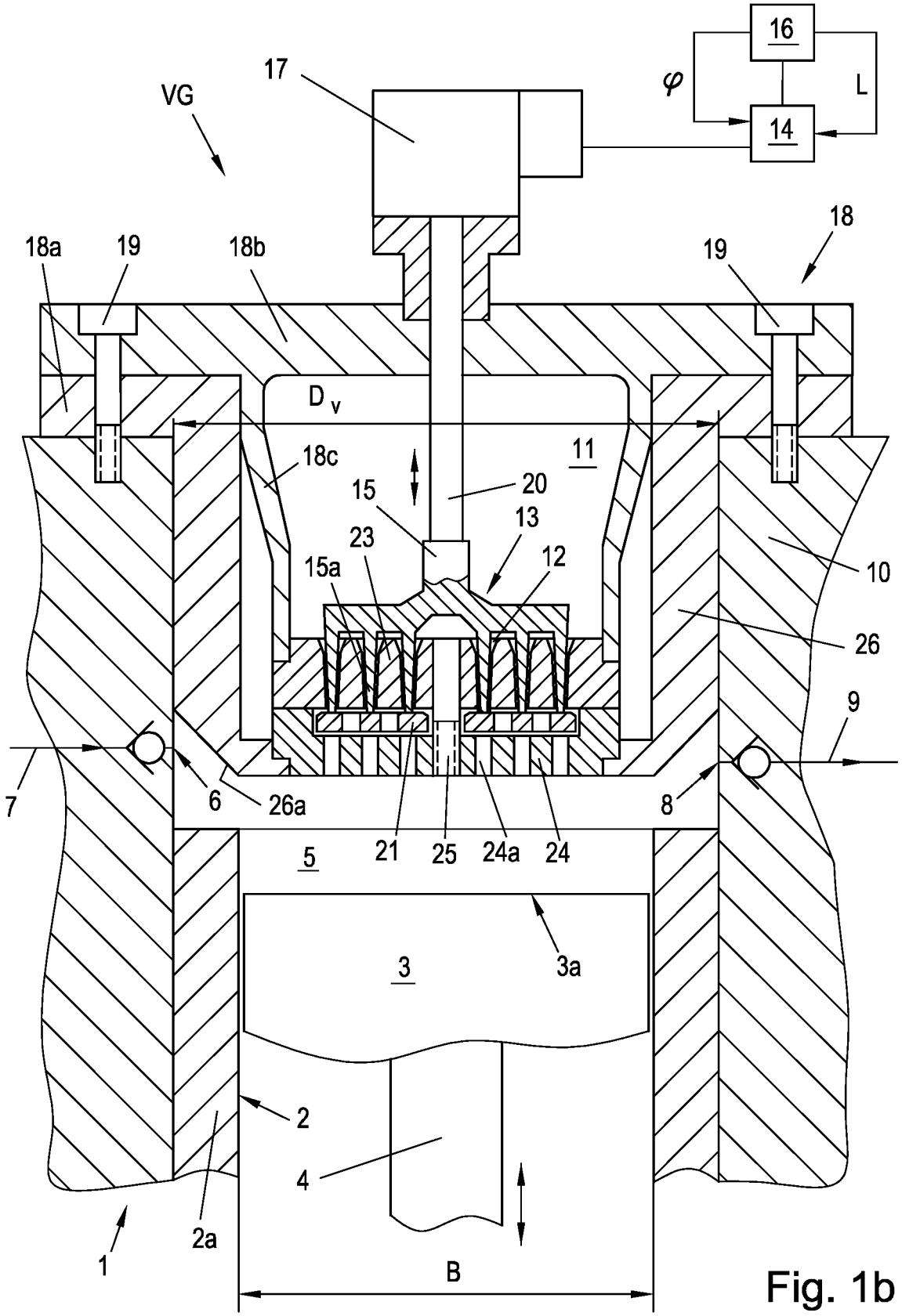
FIG. 1*b* shows a cylinder of a reciprocating compressor with a liner and with a valve assembly in an alternative embodiment.

A section through a compressor housing 10 of a reciprocating compressor 1 in the region of a cylinder 2 is shown schematically in each of FIG. 1*a* and FIG. 1*b*. Since the structure and the mode of operation of a reciprocating compressor 1 are well known, they will not be discussed in more detail at this point, but instead the components relevant to the invention and their mode of operation will be explained below. Even if only one cylinder 2 is shown here as an example, it is of course clear that the reciprocating compressor 1 can also have a plurality of cylinders 2. A piston 3 is arranged in the cylinder 2 in a known manner and can be moved back and forth in the cylinder 2. The piston 3 can be driven, for example, via a piston rod 4, which is only indicated and which oscillates in the axial direction. As is known, the piston rod 4 can in turn be driven by a push rod (not shown) via a crankshaft.

In this case, the lateral forces are absorbed by a separate joint, the so-called crosshead, which is mounted on plain bearings in the cylinder 2 or the crankcase. As a result, the piston rod 4 performs a purely axial movement. Of course, direct driving of the piston by means of a push rod would also be possible. The lateral forces are absorbed by the piston 3 and supported on the cylinder 2. However, the type of drive is secondary for the invention and essentially depends on the design, the size and the application of the reciprocating compressor 1. The crosshead design is used, for example, in double-acting reciprocating compressors. The embodiment in FIG. 1*b* differs from FIG. 1*a* in that a separate liner 2*a*, also known as a cylinder liner, is used in the compressor housing 10, and also differs by the design of the valve assembly VG of the sequence valve 13 described below. In FIG. 1*b*, the liner 2*a* thus forms the cylinder 2 and the piston 3 is moved inside the liner 2*a*.

In a known manner, a compression chamber 5 is formed in the cylinder 2 above a piston head 3*a* of the piston 3, and in this compression chamber a compression medium such as air or a certain gas is compressed by the movement of the piston 3. The compression medium can be drawn in from one or more suction lines 7 via one or more suction valves 6 and can be fed to one or more pressure lines 9 via one or more pressure valves 8. Depending on the structural design of the reciprocating compressor 1, one or more suction valves 6 and/or one or more pressure valves 8 can be arranged on the circumference of the cylinder 2, for example as shown. If a separate cylinder head (not shown) is provided on the reciprocating compressor 1, then an arrangement of the suction valve 6 and/or pressure valve 8 on the cylinder head of the reciprocating compressor 1 would also be possible. In this case, the compression chamber 5 would be formed between the piston head 3*a* of the piston 3 and the cylinder head.

In FIG. 1, the suction valve 6 and the pressure valve 8 are merely indicated as schematic non-return valves by corresponding circuit symbols. Of course, controllable valves could also be used, which can be (forcibly) actuated by an actuator, for example hydraulic, pneumatic or electromagnetically actuated valves. The specific structural design plays no significant role for the invention and is the responsibility of a person skilled in the art. Advantageously, the suction valve 6 and/or the pressure valve 8 can be designed as known automatic ring valves. The suction valve 6, designed as a ring valve, opens automatically during an expansion stroke of the piston 3 depending on the pressure ratio between a pressure in the suction line 7 and a relatively lower pressure in the compression chamber 5 in the direction of the compression chamber 5. If necessary, a preloading device, for example in the form of spring elements, can also be provided on the suction valve 6 in order to generate a preloading force by which the suction valve 6 is preloaded in the direction of the closed state. This can influence the opening and closing behavior.

In an analogous manner, the pressure valve 8, designed as a ring valve, opens automatically during a compression stroke of the piston 3 depending on the pressure ratio between a pressure in the pressure line 9 and the relatively higher pressure in the compression chamber 5 in the direction of the pressure line 9. If necessary, a preloading device, for example in the form of spring elements, can also be provided on the pressure valve 8 in order to generate a preloading force, by which the pressure valve 8 is preloaded in the direction of the closed state. Depending on the specific structural design of the reciprocating compressor 1, a certain constant delivery rate thus results for each speed of the reciprocating compressor 1. In the case of large compressors, which are usually operated at a constant speed, the delivery rate is therefore essentially constant.

However, it is often desirable to change the delivery rate despite the constant speed. As mentioned at the outset, one or more connection chambers with a constant or variable connection chamber volume can be provided for this purpose, and can be selectively connected to the compression chamber 5. As a result, the dead space in the cylinder 2 is increased, whereby the pressure increase or decrease in the compression chamber 5 can be flattened, as will be explained in more detail below with reference to FIG. 2. In the illustrated reciprocating compressor 1, a single connection chamber 11 with an unchangeable connection chamber volume is provided. The connection chamber 11 is connected to the compression chamber 5 via at least one overflow opening 12. Furthermore, a sequence valve 13 for opening and closing the overflow opening 12 and a sequence valve control unit 14 for activating the sequence valve are provided. Of course, this is only to be understood as an example and not as a restriction. In principle, for example, several parallel connection chambers 11 could also be provided, each with a sequence valve 13 according to the invention, or several connection chambers 11 could be provided which are serially connected to one another via valves with a common sequence valve 13 according to the invention for the compression chamber 5. It would also be conceivable that a connection chamber 11 with a sequence valve 13 according to the invention is provided, the volume of the connection chamber being variable, for example by means of a piston. However, the example shown is sufficient for an understanding of the invention.

For example, a separate unit in the form of suitable hardware and/or software can be provided as the sequence valve control unit 14. The sequence valve control unit 14 can be controlled, for example, by a higher-level compressor control unit 16 of the reciprocating compressor 1, but could of course also be integrated into this unit. The compressor control unit 16 can, for example, transmit a load signal L about the current load state of the reciprocating compressor 1 to the sequence valve control unit 14. Depending on this, the sequence valve control unit 14 can set a specific operating mode for the capacity regulation and can set and change the closing point SP and the opening point OP of the sequence valve 13 accordingly depending on the load signal L.

A supply quantity (=delivered quantity of the compressed compression medium), a power consumption of an electric drive machine of the reciprocating compressor (=drive machine load) or a pressure of the compressed compression medium can be used, for example, as a load signal L, wherein in the case of multi-stage compressors, for example, an intermediate pressure between two compression stages can be used. In order to be able to assign the closing point SP and the opening point OP of the sequence valve 13 to the compression cycle, the compressor control unit 16 can, for example, also transmit a crank angle signal φ to the sequence valve control unit 14. The crank angle signal φ can be detected by a crank angle sensor of the reciprocating compressor 1, for example. As a result, a closed control loop can be implemented in an advantageous manner, so that precise control of the closing point SP is made possible.

According to the invention, the sequence valve 13 is designed as an automatic ring valve which automatically opens and closes the overflow opening(s) 12 depending on a pressure ratio between a pressure in the connection chamber 11 and a pressure in the compression chamber 5, wherein the sequence valve opens in the direction of the compression chamber 5 when the pressure in the connection chamber is greater than the pressure in the compression chamber 5. In addition, an unloader 15 is provided, which can be actuated by a suitable actuator 17. The unloader 15 is provided in order to keep the sequence valve 13 in an open state after it has opened automatically, as will be explained in detail below with reference to FIG. 2. The actuator 17 can be controlled by the sequence valve control unit 14 (or the compressor control unit) in order to actuate the unloader 15. A suitable actuator 17 is an actuator with a sufficiently short actuation time (or sufficiently high switching frequency) that can generate a sufficiently great actuation force to keep the sequence valve 13 open. An electrohydraulic actuator or an electromagnetic actuator is preferably provided as the actuator 17. Electromagnetic actuators have the advantage that they enable relatively short actuation times or high switching frequencies and that no hydraulic fluid is required. Electrohydraulic actuators have the advantage that relatively great actuation forces can be generated. Depending on the requirements, a person skilled in the art can provide a suitable actuator 17. In the illustrated embodiment, the actuator 17 is designed, for example, as an electromagnetic actuator.

As shown in FIG. 1*a* and FIG. 1*b*, a separate valve assembly VG with an optionally multi-part valve housing 18 can be provided, for example, in which the connection chamber 11 is arranged. The valve assembly VG can be arranged in the region of the cylinder 2 on the compressor housing 10 of the reciprocating compressor 1. If the reciprocating compressor has a separate cylinder head (not shown), then the valve assembly VG can be installed, for example, at an opening provided for this purpose on the cylinder head of the reciprocating compressor. In the following, however, reference is made to the variant shown without a cylinder head. The valve assembly VG can be fastened to the compressor housing 10 with suitable fastening means 19, for example with a plurality of screws distributed around the circumference, as indicated schematically in FIG. 1*a* and FIG. 1*b*. As a result, for example, capacity regulation can be easily retrofitted to existing reciprocating compressors 1 without having to carry out extensive structural changes. The valve housing 18 preferably has a cylindrical valve housing portion 26 with a valve housing diameter $D_V$. In the fastened state of the valve assembly VG on the reciprocating compressor 1, the valve housing portion 26 is arranged at least partially inside the cylinder 2. In FIG. 1*b*, the cylindrical valve housing portion 26 is not arranged directly in the cylinder 2 in which the piston 3 moves, but rather in a cylindrical receiving opening provided for receiving the liner 2*a*. In the example according to FIG. 1*a*, the valve housing diameter $D_V$ essentially corresponds to the bore diameter B of the cylinder 2. In the example according to FIG. 1*b*, the valve housing diameter $D_V$ is slightly greater than the bore diameter B due to the liner 2*a* and essentially corresponds to the diameter of the cylindrical receiving opening.

The actuator 17 is preferably arranged outside the valve housing 18 and is connected to the unloader 15 via a transmission rod 20 which protrudes through a wall of the valve housing 18 into the connection chamber 11. On the one hand, this is advantageous for thermal reasons because the actuator 17 is not exposed to the temperatures and pressures in the connection chamber 11. On the other hand, a simpler electrical connection to the sequence valve control unit 14 is thus possible. In addition, the connection chamber 11 can be made smaller with the same connection chamber volume, because the volume of the actuator 17 does not reduce the connection chamber volume of the connection chamber 11. The valve housing 18 is advantageously constructed in several parts. In the example shown in FIG. 1*a* and FIG. 1*b*, the valve housing 18 has a first housing part 18*a*, on which the cylindrical valve housing portion 26 is provided and on which the sequence valve 13 is arranged, and a second housing part 18*b*, which is designed here in the form of a housing cover. In this case the connection chamber 11 is formed by the first and second housing parts 18*a*, 18*b* or is delimited thereby. Due to the multi-part design, easier assembly and maintenance of the sequence valve 13 are possible, among other things. The actuator 17 is arranged outside on the second housing part 18*b* or housing cover and the transmission rod 20 protrudes through the housing cover into the connection chamber 11.

The use according to the invention of an automatic ring valve with unloader 15 and a suitable, in particular electromagnetic, actuator 17 now makes it possible to react very precisely to load changes of the compressor 1 within a very short time, in particular within one compression cycle or one revolution of the crankshaft. For example, it is possible to close the sequence valve 13 in the compression stroke within a maximum of 5°, preferably a maximum of 3° crank angle after the unloader 15 has been actuated. In the prior art, such rapid control of the sequence valves was previously not possible due to the valve geometries used and in particular due to the relatively slow pneumatic or exclusively hydraulic actuation.

By the use of a ring valve in particular, the capacity regulation can be used particularly advantageously with larger reciprocating compressors 1 that have a bore diameter B of the cylinder 2 of at least 100 mm, preferably at least 500 mm, particularly preferably at least 800 mm. The bore diameter B is formed in FIG. 1*b* by the inner diameter of the liner 2*a*. Conventional seat valves used hitherto quickly reach their limits here because the overflow cross section of the overflow opening is relatively small for a comparable valve lift in relation to the valve surface facing the compression chamber due to the design. As a result, when using conventional seat valves in large reciprocating compressors, there would be relatively strong throttling in the region of the overflow opening, which would lead to undesired heating of the compressed compression medium due to the throttling losses.

Although a greater valve lift would partially reduce this disadvantage, it would lead to longer closing times, which is also disadvantageous because, under certain circumstances, a sufficiently rapid reaction to load changes would not be possible. On the other hand, it is often not possible to increase the valve lift because the axial space in the compression chamber is limited. In addition, with seat valves, due to the comparatively large valve area, relatively large forces would be required to keep the valve open in the compression stroke, which under certain circumstances could not be applied by an actuator, or could only be applied insufficiently. Due to their design, ring valves therefore have great advantages over seat valves, in particular the greater the bore diameter B of the cylinder 2 is. The ring valve is preferably dimensioned such that a flow cross-sectional area of the overflow opening(s) 12 when the sequence valve 13 is open is at least 5% of a bore cross-sectional area of the bore of the cylinder 2 or a cross-sectional area of the cylindrical valve housing section 26 with the housing diameter $D_V$, preferably at least 10%, more preferably at least 15%. As a result, a sufficiently large area can be made available so that the compression medium does not heat up to an unacceptably high level as a result of throttling in the region of the overflow opening(s) 12.

Furthermore, it is advantageous that the actuator 17 has a switching frequency of at least 5 Hz, preferably at least 10 Hz, particularly preferably at least 20 Hz. As a result, the unloader 15 can be actuated very quickly, so that closing times of the sequence valve 13 of less than 5° CA, preferably less than 3° CA, can be implemented. In the example shown, the suction valve 6 and the pressure valve 8 are arranged on a peripheral surface of the cylinder 2 in the compression chamber 5 and the sequence valve 13 is arranged on an end face of the cylinder 2 in the compression chamber 5 opposite the piston head 3*a* of the piston 3. This arrangement is advantageous because it means that a relatively large area is available for the sequence valve 13. Of course, a different arrangement would also be conceivable in principle. In the example shown, a bevel 26*a* is provided at the free end of the cylindrical housing portion 26 of the first housing part 18*a*, which faces the compression chamber 5 in the assembled state, at least in the region of the pressure and suction valves 6, 8. In order to simplify manufacture, the bevel 26*a* is preferably in the form of a chamfer running around the entire circumference of the housing portion 26. As a result, in the installed state of the valve assembly VG on the reciprocating compressor 1 in the region of the suction and pressure valves 6, 8, an annular gap is formed with a substantially triangular cross section. This allows the compression medium to flow over the valves 6, 8 even when the piston 3 is at top dead center.

In order to achieve as large an available overflow cross section as possible, the sequence valve 13 preferably has a plurality of concentrically arranged overflow openings 12, which are at least partially annular, as is shown, for example, in FIG. 1*b*. Each overflow opening 12 is assigned a corresponding sealing element 21 which seals the relevant overflow opening 12 when the sequence valve 13 is in the closed state. The unloader 15 acts on the sealing elements 21 through the at least partially annular overflow openings 12 by means of unloader fingers 15*a*. In a known manner, of course, a plurality of annular sealing elements 21 can also be connected via radial webs to form a common sealing plate, as indicated in FIG. 1*b*. Such ring valves are basically known from the prior art, for example from EP 2 876 303 B1, for suction valves, which is why only the basic structure will be discussed at this point.

As shown by way of example in FIG. 1*a*, the sequence valve 13 can have a valve support 22 which is arranged in an opening provided for this purpose in the valve housing 18 and can be fastened to the valve housing 18 by means of suitable fastening means 27 such as screws. In the example shown in FIG. 1*a*, the valve support 22 thus forms a part of the valve housing 18 which faces the compression chamber 5 when installed on the reciprocating compressor 1. Of course, a suitable seal (not shown) can also be arranged between the valve support 22 and the housing 18. A recess in which a valve seat plate 23 is arranged is provided in the valve support 22. The valve seat plate 23 can in turn be fastened to the valve support 22 by suitable fastening means 28 such as screws. One (FIG. 1*a*) or preferably a plurality of (FIG. 1*b*) preferably concentric annular overflow openings 12 are arranged on the valve seat plate 23. A suitable seal (not shown) can in turn be provided between the valve seat plate 23 and the valve support 22.

The sequence valve 13 preferably also has a so-called valve catcher 24, which, for example in the example according to FIG. 1*a*, can be fastened in a suitable manner on the side of the valve seat plate 23 which faces the outside of the valve housing 18, and which, in the installed state on the reciprocating compressor 1, faces the compression chamber 5. For example, the valve catcher 24 may be formed as a substantially circular plate. The valve catcher 24 can, for example, be fastened to the valve seat plate 23 via a central fastening element 25, for example in the form of a threaded rod. The sealing element or elements 21 is/are arranged so as to be movable in the axial direction between the valve seat plate 23 and the valve catcher. The sealing element or elements 21 is/are preferably made from a material with sufficiently high strength and the best possible sealing effect, for example from a suitable plastics material. Optionally, a preloading device can also be provided in order to preload the sealing element or elements 21 in the direction of the valve seat plate 23 in the closed position. A plurality of spring elements (not shown) distributed in the circumferential direction, for example helical springs, can be provided as a preloading device between the sealing element or elements 21 and the valve catcher 24.

In the closed state of the sequence valve 13, the sealing element or elements 21 is/are in contact with the valve seat plate 23 and close the overflow openings 12 of the valve seat plate 23. If the pressure in the connection chamber 11 exceeds the pressure in the compression chamber and, if applicable, any preloading force of the preloading device during the expansion stroke of the piston 3, the sealing element or elements 21 is/are automatically displaced in the direction of the valve catcher 24. When the sequence valve 13 is in its maximum open state, the sealing element or elements 21 can also bear against the valve catcher 24. The valve lift can thus be limited by the valve catcher 24. Suitable openings 24*a* are advantageously also provided in the valve catcher 24 in order to keep the throttling effect of the open sequence valve 13 as low as possible.

The unloader 15 is arranged here inside the connection chamber 11 and the unloader fingers 15*a* of the unloader 15 protrude through the overflow openings 12 in order to act on the sealing element(s) 21. The unloader 15 is connected to the actuator 17 by means of the transmission rod 20. The actuator 17 can be controlled by the sequence valve control unit 14 in order to actuate the unloader 15. The working stroke of the unloader 15 can be fixed, but could also be adjustable, for example by means of a suitable adjusting device that can be provided in the valve assembly VG. The adjusting device could, for example, be designed in such a way that the length of the transmission rod 20 can be changed or that a common position of the actuator 17 including the transmission rod 20 and the unloader 15 can be adjusted.

In FIG. 1*b*, the valve assembly VG has a different design than in FIG. 1*a*, wherein only the essential differences are discussed below. The basic function remains unchanged. The sequence valve 13 in FIG. 1*b* has a valve seat plate 23 in which three concentric annular overflow openings 12 are provided. Correspondingly, the sequence valve 13 has three annular sealing elements 21 that interact therewith. The sealing elements 21 are connected to one another here and form a common sealing plate. Of course, individual annular sealing elements 21 that can be moved independently of one another would also be possible. Consequently, the unloader 15 has at least one unloader finger 15*a* per overflow opening 12. In contrast to the example according to FIG. 1*a*, the sequence valve 13 in FIG. 1*b* does not have a separate valve support 22 which is fastened in the valve housing by means of fastening means 27, such as, for example, screws.

In FIG. 1B, on the other hand, the valve catcher 24 is designed in such a way that it forms a part of the valve housing 18 that faces the compression chamber 5 in the assembled state. In the example shown, a first step is provided on an outer peripheral surface of the valve catcher 24 and a second step corresponding to the first step is provided on an inner peripheral surface of the opening of the valve housing 18 facing the compression chamber 5. The first step of the valve catcher 24 rests against the second step of the valve housing 18 in the assembled state. As a result, the valve catcher 24 is centered in the valve housing 18 and closes the opening in the valve housing 18 from the side of the connection chamber 11, i.e. from the inside. On the side of the valve catcher 24 facing the connection chamber 11 there is a contact surface on which the valve seat plate 23 rests. The valve catcher 24 can, for example, in turn be connected to the valve seat plate 23 by a central fastening element 25, for example in the form of a threaded rod.

In contrast to FIG. 1*a*, a holding portion 18*c* is additionally provided on the valve housing 18 in the example according to FIG. 1*b*. The holding portion 18*a* is arranged on the side of the second housing part 18*b*, in this case the housing cover, which faces the connection chamber 11. In the assembled state of the valve assembly VG, the holding portion 18*c* protrudes into the connection chamber 11 and contacts the valve seat plate 23. For this purpose, for example, a holding shoulder can be provided on the side of the valve seat plate 23 facing the connection chamber 11, as shown in FIG. 1*b*, and can also serve for centering. The holding portion 18*c* can, for example, have holding fingers distributed over the circumference and arranged at a distance from one another in the circumferential direction. The holding portion 18*c* can preferably also be designed in the form of an at least partially cylindrical holding sleeve, so that a holding force that is as uniform as possible can be exerted on the valve seat plate 23 in the circumferential direction. In the installed state, the holding portion 18*c* presses on the valve seat plate 23 and thereby fixes the valve seat plate 23 including the valve catcher 24 in the direction of actuation of the sequence valve 13 in the valve housing 18. If the holding portion 18*c* is designed as a closed holding sleeve, then the connection volume of the connection chamber 11 is provided within the holding sleeve. The space outside the sleeve is therefore not part of the connection volume and therefore does not contribute to increasing the dead space. If necessary, however, suitable connection openings could also be provided on the circumference of the holding sleeve in order to increase the connection volume.

As a result, in the embodiment according to FIG. 1*b* advantageously no holding means are required in order to fasten the valve seat plate 23 and/or the valve catcher 24 on the valve housing 18. The holding force is generated here via the fastening means or, in particular, screws 19, by which the entire valve housing 18 (i.e. the first, lower housing part 18*a* and the second, upper housing part 18*b* together) is fastened to the compressor housing 10. In the example shown, the holding portion 18*c* is designed as an integral part of the second housing part 18*b* or housing cover. Of course, this is only to be understood as an example and the holding portion 18*c* could, for example, also be designed in the form of one or more separate components which could, for example, be fastened in a suitable manner to the second housing part 18*b*, in this case the housing cover. With a suitable design, a fixed fastening to the second housing part 18*b* could also be dispensed with under certain circumstances.

Figure 2:
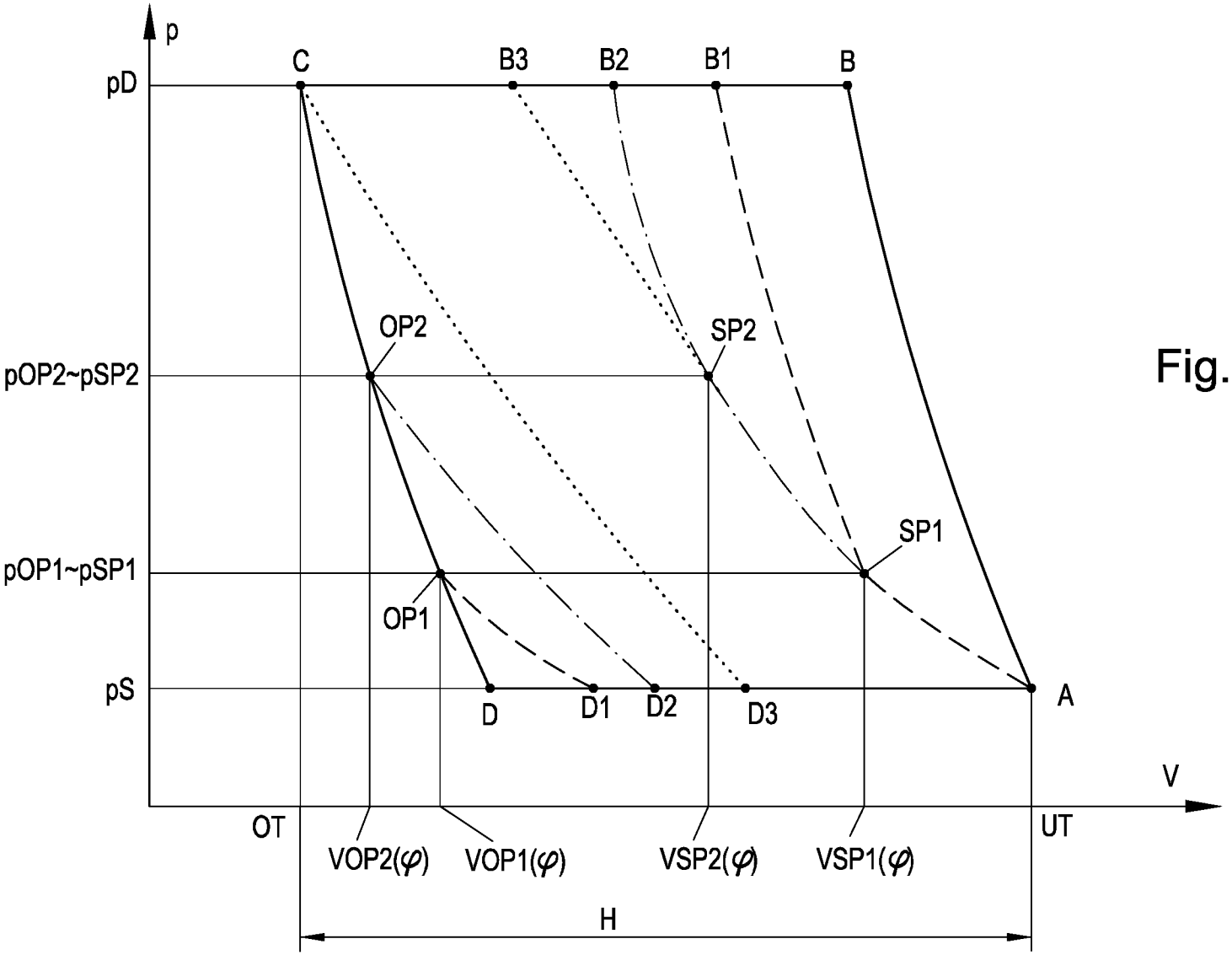
FIG. 2 shows a pressure-volume diagram of a reciprocating compressor with different operating points for the capacity regulation FIG. 3*a*-3*d* each show a pressure-volume diagram of a reciprocating compressor with one operating point for the capacity regulation.

The use of the valve assembly VG in a method for regulating the capacity of the reciprocating compressor 1 is explained in more detail below with reference to FIG. 2. FIG. 2 shows a pressure-volume diagram of the reciprocating compressor 1, wherein the pressure p in the compression chamber 5 is plotted on the ordinate and the volume V in the compression chamber 5 is plotted on the abscissa. The pressure p and the volume V change in a known manner depending on the piston stroke of the piston 3 between a bottom dead center UT and a top dead center OT and depending on the switching points of the suction and pressure valves 6, 8. The solid line between the points A-B-C-D-A represents a work cycle with a deactivated connection chamber 11 or a reciprocating compressor 1 without connection chamber 11.

At point A, the piston 3 is at bottom dead center UT at the beginning of the compression stroke, with the suction valve 6 and the pressure valve 8 closed. The movement of the piston 3 compresses the compression medium in the compression chamber 5 until the opening pressure pD of the pressure valve is reached and the pressure valve 8 opens at point B. The compressed compression medium is displaced from the compression chamber 5 into the pressure line 9 through the open pressure valve 8. At point C, the piston 3 reaches top dead center OT and the pressure valve 8 closes. The expansion stroke of the piston 3 now begins, with the piston 3 being moved again in the opposite direction towards bottom dead center UT. The volume in the compression chamber 5 increases again and the pressure p decreases.

Figure 3A:
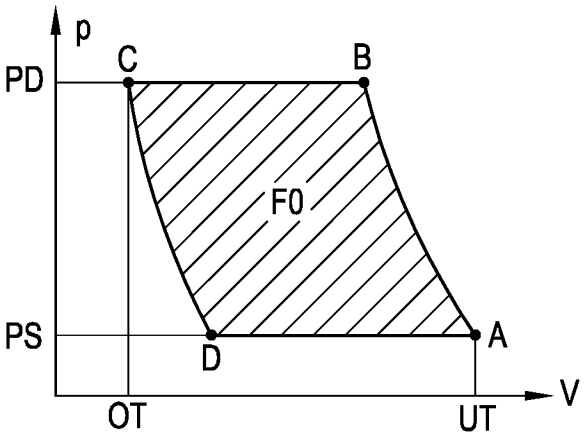

When the opening pressure pS of the suction valve 6 is reached, the suction valve 6 opens and fresh compression medium is drawn in through the suction valve 6 from the suction line 7 at an essentially constant pressure until the piston 3 again reaches the bottom dead center UT and the work cycle is completed. The area F0 enclosed by the solid line between the points A-B-C-D-A corresponds to the maximum work of the compressor 1 with the connection chamber 11 deactivated or of a reciprocating compressor 1 without the connection chamber 11, as shown in FIG. 3*a*. The work is essentially proportional to the delivery rate, and therefore the area F can generally be viewed as a measure of the delivery rate or the capacity of the reciprocating compressor 1. In order to reduce the delivery rate, this area F can now be specifically influenced by connecting the compression chamber 5 to the connection chamber 11 by opening the sequence valve 13 or separating them again by closing the sequence valve 13, as explained below.

Figure 3B:
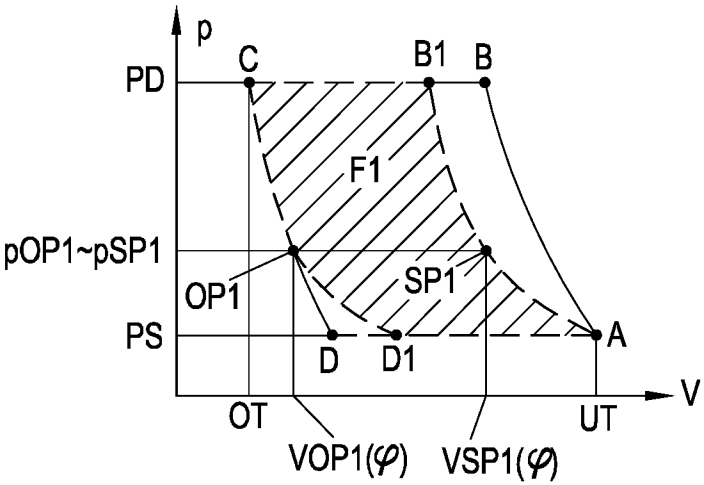
Figure 3C:
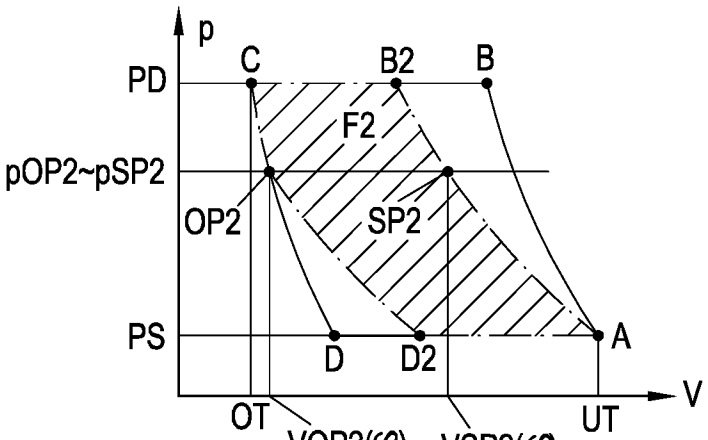
Figure 3D:
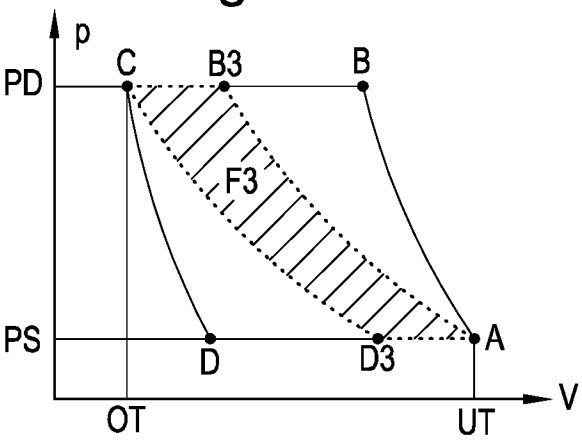

By selection of the closing point SP and opening point OP of the sequence valve 13, the delivery rate can be set essentially steplessly between the maximum delivery rate (area F0) and a minimum delivery rate (area F3-FIG. 3*d*). In order to set the minimum delivery rate, the sequence valve 13 can be kept permanently in the open state by means of the unloader 15. The compression chamber 5 is thus permanently connected to the connection chamber 11 via the overflow opening(s) 12, so that the dead space is substantially permanently enlarged as a result. In the pressure-volume diagram in FIG. 2, this can be seen from the fact that the compression line A-B3 (dotted line) runs much flatter than the compression line AB (solid line) for operation without the connection chamber 11. The opening pressure pD is therefore reached much later in the compression stroke, so that the pressure valve 8 opens correspondingly later at point B3. The same applies to the dotted expansion line C-D3, which is significantly flatter than the solid expansion line C-D for operation without the connection chamber 11, as a result of which the opening pressure pS is reached later in the expansion stroke and the suction valve 6 opens correspondingly later at point D3. The operation with minimum delivery rate is shown in FIG. 3*d*. It can be seen that the area F3 enclosed by the dotted lines between A-B3-C-D3-A is significantly smaller than the area F0 between A-B-C-D shown in FIG. 3*a*, which corresponds to the maximum delivery rate.

By appropriate control of the sequence valve 13, the delivery rate of the compressor 1 can now be steplessly adjusted between the maximum delivery rate (area F0-FIG. 3*a*) and the minimum delivery rate (area F3-FIG. 3*d*), as exemplified by a first operating mode in the pressure-volume diagram in FIG. 3*b* and by a second operating mode in the pressure-volume diagram in FIG. 3*c*. The first area F1 enclosed by the dashed line in FIG. 3*b* is larger than the second area F2 enclosed by the dash-dot line in FIG. 3*c*. The delivery rate of the first operating mode is proportional to the first area F1 and is therefore greater than the delivery rate of the second operating mode, which is proportional to the second area F2. The control of the sequence valve 13 is explained in more detail below with reference to FIG. 2.

Since the sequence valve 13 is designed according to the invention as an automatic ring valve, during the expansion stroke of the piston 3, purely due to the pressure ratio between the pressure in the connection chamber 11 and the relatively lower pressure in the compression chamber (5), the sealing element(s) 21 are lifted off from the valve seat plate 23 in the direction of the compression chamber 5, whereby the overflow opening(s) 12 are exposed. As a result, no additional opening force is required, which would have to be applied by the actuator 17 via the unloader 15. In the first operating mode (FIG. 2+FIG. 3*b*), the sequence valve 13 opens, for example, at a first opening point OP1 in the expansion stroke at a first sequence valve opening pressure pOP1 in the compression chamber 5, which pressure lies between the opening pressure pD of the pressure valve 8 and the opening pressure pS of the suction valve 6, and at a first sequence valve opening volume VOP1.

In the second operating mode (FIG. 2+FIG. 3*c*), the sequence valve 13 opens, for example, at a second opening point OP2 in the expansion stroke at a second sequence valve opening pressure pOP2 in the compression chamber 5, which pressure lies between the opening pressure pD of the pressure valve 8 and the opening pressure pS of the suction valve 6, and at a second sequence valve opening volume VOP2. As is known, the volume V in the compression chamber 5 in a reciprocating compressor 1 is generally dependent on the crank angle φ of the crankshaft, i.e. V(φ), as shown on the abscissa in FIG. 2. The opening point OP of the sequence valve 13 can thus be assigned to the crank angle φ. As mentioned, the crank angle φ can be detected, for example, by a crank angle sensor and transmitted to the sequence valve control unit 14 in the form of a crank angle signal φ.

As can be seen in FIG. 2 and FIG. 3*b*, in the first operating mode from the first opening point OP1, due to the now enlarged dead space in the cylinder 2 the dashed expansion curve runs substantially flatter than the solid expansion curve in the operating mode without or with the deactivated connection chamber 11. As a result, the point in time at which the suction valve 6 opens is shifted to a later point in time D1. After the automatic opening of the sequence valve 13, the unloader 15 is activated by the actuator 17 in order to follow the opening movement of the sequence valve 13 or of the sealing element(s) 21. This movement can take place, for example, within a period of up to 20° crank angle and requires little or no effort from the actuator 17. As a result, the mechanical and thermal stress on the valve assembly VG can advantageously be kept low.

The sealing element(s) 21 of the sequence valve 13 are held in the open position by the unloader fingers 15*a* of the unloader 15 until the following compression stroke, after the suction valve 6 has already been closed again at point A. For this purpose, the actuator 17 generates a holding force that counteracts a closing force that is exerted on the sealing element or elements 21 by the pressure ratio between the pressure in the compression chamber 5 and the (relatively lower) pressure in the connection chamber 11 and the resulting flow of the compression medium into the connection chamber 11. By the use of a ring valve as the sequence valve 13 according to the invention, the required holding force that has to be applied by the actuator 17 can be kept relatively low, which means that the mechanical loads on the valve assembly VG can consequently also be kept low.

To close the sequence valve 13, the unloader 15 is deactivated, that is to say moved away from the sealing elements 21 in the opposite direction, in that the actuator 17 is controlled by the sequence valve control unit 14 at a specified point in time. This results in a reduction or removal of the holding force, so that in the first operating mode the sequence valve 13 closes automatically at the first closing point SP1 by the flow forces acting on the sealing element(s) 21. The sequence valve 13 is preferably designed in such a way that the flow forces acting during the closing process result in a deformation, in particular a deflection, of the sealing element(s) 21. This temporarily leads to a further narrowing of the flow cross-section, which generates an increased pressure drop during the closing process. As a result, a sufficiently high restoring force can be generated so that the closing process is made possible in a crank angle range of at most 5°, preferably at most 3° crank angle after deactivation of the unloader 15.

After closing of the sequence valve 13 at the first closing point SP1 at a first sequence valve closing pressure pSP1 in the compression chamber 5 and a first sequence valve closing volume VSP1(φ) in the compression chamber 5, the pressure prevailing at this point in time in the connection chamber 11 is enclosed and essentially corresponds to the first sequence valve closing pressure pSP1. By selection of the first closing point SP1, the first opening point OP1 of the sequence valve 13 can consequently also be defined in the subsequent expansion stroke. The sequence valve closing pressure pSP1 and the sequence valve opening pressure pOP1 are (ignoring pressure losses) essentially at the same pressure level pSP1~pOP1, as can be seen in FIG. 2. The first closing point SP1 of the sequence valve 13 can be defined depending on the crank angle φ by the assignment of the first sequence valve closing volume VSP1(φ) to the crank angle φ. The sequence valve control unit 14 can therefore control the actuator 17 depending on the crank angle φ in such a way that the sequence valve 13 is closed at the specified first closing point SP1.

In FIG. 3*c*, the second operating mode is shown with a lower delivery rate (proportional to the area F2) compared to the first operating mode in FIG. 3*b*. It can be seen that the second closing point SP2 of the sequence valve 13 is later in the compression stroke than the first closing point SP1. The dot-dash compression line of the second operating mode therefore runs flatter up to the second closing point SP2 and only then rises again due to the smaller dead space. Due to the later second closing point SP2, the second opening point OP2 is consequently again defined in the subsequent expansion stroke, because the sequence valve closing pressure pSP2 and the sequence valve opening pressure pOP2 are essentially at the same pressure level pSP2 pOP2. As can be seen in FIG. 2, this is earlier in the expansion stroke (VOP2(φ)<VOP1(φ)) than the first opening point OP1 due to the higher enclosed pressure in the connection chamber 11 compared to the first operating mode. The dot-dash expansion curve therefore already flattens out from the second opening point OP2, so that the opening pressure pS of the suction valve 6 is reached at a later point in time D2 relative to point D and relative to point D1.

As already mentioned, it is advantageous if the sequence valve control unit 14 receives a load signal L of the reciprocating compressor 1, for example from the compressor control unit 16 (FIG. 1). As a result, the sequence valve control unit 14 can set a desired operating mode of the sequence valve 13 depending on the load of the reciprocating compressor 1. The design of the sequence valve 13 according to the invention with an unloader 15 and suitable actuator 17 also makes it possible for the operating mode of the sequence valve 13 to be changed within a very short time depending on the load of the compressor 1. For example, the closing point SP can be changed within a compression cycle (which corresponds to one revolution of the crankshaft in a reciprocating compressor), e.g. from a first closing point SP1 to a second closing point SP2, as shown in FIG. 2.

What is claimed is:

1. A reciprocating compressor comprising:

a cylinder, a piston configured and arranged to move back and forth in the cylinder in order to form a compression chamber in the cylinder, at least one suction valve and at least one pressure valve are provided on the compression chamber, at least one connection chamber with a connection chamber volume, which is connected to the compression chamber via at least one overflow opening, a sequence valve configured and arranged to open and close the at least one overflow opening, a sequence valve control unit configured and arranged for controlling the sequence valve, characterized in that the sequence valve is an automatic ring valve configured and arranged to automatically open and close the at least one overflow opening depending on a pressure ratio between a pressure in the at least one connection chamber and a pressure in the compression chamber, wherein the sequence valve is further configured and arranged to open automatically when the pressure in the at least one connection chamber is greater than the pressure in the at least one compression chamber, and an unloader configured and arranged to be actuated by an electrically controllable actuator in order to keep the sequence valve in an open state independently of the pressure ratio, and in that the electrically controllable actuator can be actuated by the sequence valve control unit for actuation.

2. The reciprocating compressor according to claim 1, characterized in that a flow cross-sectional area of the at least one overflow opening in the open state of the sequence valve is at least 5% of a bore cross-sectional area of a bore of the cylinder (2).

3. The reciprocating compressor according to claim 1, characterized in that a bore diameter of a bore of the cylinder is at least 100 mm.

4. The reciprocating compressor according to claim 1, characterized in that the actuator has a switching frequency of at least 5 Hz.

5. The reciprocating compressor according to claim 1, wherein the electrically controllable actuator is an electromagnetic actuator or an electrohydraulic actuator.

6. The reciprocating compressor according to claim 1, characterized in that the suction valve and/or the pressure valve is an automatic valve.

7. The reciprocating compressor according to claim 1, characterized in that the suction valve and/or the pressure valve are arranged on a peripheral surface of the cylinder in the compression chamber and/or the sequence valve is arranged on an end face of the cylinder opposite the piston head of the piston.

8. The reciprocating compressor according to claim 1, characterized in that the sequence valve has a plurality of concentrically arranged overflow openings, the overflow openings being at least partially annular, wherein each of the plurality of overflow openings is assigned a sealing element of a plurality of sealing elements and the unloader acts on the plurality of sealing elements through the overflow openings.

9. The reciprocating compressor according to claim 8, characterized in that the plurality of sealing elements are annular sealing elements, which are connected via radial webs to form a sealing plate.

10. The reciprocating compressor according to claim 1, characterized in that the sequence valve has a valve housing in which the connection chamber is provided, and wherein the electrically controllable actuator is an electromagnetic actuator arranged outside the valve housing, and the actuator is connected to the unloader via a transmission rod which protrudes through a wall of the valve housing into the connection chamber.

11. The reciprocating compressor according to claim 1, characterized in that the sequence valve control unit is configured and arranged to control the sequence valve depending on a load signal and/or depending on a crank angle signal of the reciprocating compressor.

* * * * *